US008127846B2

(12) United States Patent
Hill et al.

(10) Patent No.: US 8,127,846 B2
(45) Date of Patent: Mar. 6, 2012

(54) WIPER PLUG PERFORATING SYSTEM

(75) Inventors: Freeman L. Hill, Spring, TX (US); Randy L. Evans, Sugar Land, TX (US); John H. Clark, Grampian (GB); Mark L. Sloan, Magnolia, TX (US); William D. Myers, Jr., Spring, TX (US); Joseph Gregory Barolak, Spring, TX (US); George Patton, Weaterford, TX (US)

(73) Assignee: Baker Hughes Incorporated, Houston, TX (US)

( * ) Notice: Subject to any disclaimer, the term of this patent is extended or adjusted under 35 U.S.C. 154(b) by 104 days.

(21) Appl. No.: 12/394,598

(22) Filed: Feb. 27, 2009

(65) Prior Publication Data

US 2010/0096131 A1 Apr. 22, 2010

Related U.S. Application Data

(60) Provisional application No. 61/031,966, filed on Feb. 27, 2008.

(51) Int. Cl.
*E21B 33/10* (2006.01)

(52) U.S. Cl. ..... 166/285; 166/297; 166/193; 166/153; 166/177.3

(58) Field of Classification Search ..... 166/285, 166/291, 297, 192, 193, 153, 177.3, 177.4
See application file for complete search history.

(56) References Cited

U.S. PATENT DOCUMENTS

| | | | | |
|---|---|---|---|---|
| 3,656,562 | A * | 4/1972 | Baugh | 175/4.51 |
| 3,713,486 | A * | 1/1973 | Meitzen | 166/285 |
| 6,595,289 | B2 * | 7/2003 | Tumlin et al. | 166/286 |
| 6,896,059 | B2 * | 5/2005 | Brooks et al. | 166/297 |
| 7,540,326 | B2 * | 6/2009 | Rytlewski | 166/297 |
| 7,552,779 | B2 * | 6/2009 | Murray | 166/386 |
| 7,686,092 | B2 * | 3/2010 | Szarka | 166/386 |
| 7,779,926 | B2 * | 8/2010 | Turley et al. | 166/387 |
| 2005/0241835 | A1 * | 11/2005 | Burris et al. | 166/381 |
| 2006/0144590 | A1 * | 7/2006 | Lopez de Cardenas et al. | 166/276 |
| 2007/0227735 | A1 * | 10/2007 | Rytlewski | 166/298 |
| 2010/0051278 | A1 * | 3/2010 | Mytopher et al. | 166/298 |
| 2010/0163224 | A1 * | 7/2010 | Strickland | 166/254.1 |
| 2011/0048719 | A1 * | 3/2011 | Baihly et al. | 166/305.1 |

* cited by examiner

*Primary Examiner* — Jennifer H Gay
*Assistant Examiner* — Elizabeth Gottlieb
(74) *Attorney, Agent, or Firm* — Bracewell & Giuliani LLP

(57) ABSTRACT

A method and system for cementing and perforating a wellbore in a single step by coupling a perforating gun with a wiper plug. The method includes injecting cement in a wellbore having casing therein and an annulus between the casing and wellbore. A wiper plug is dropped on the cement having a perforating gun attached to the wiper plug. The plug is forced downward pulling the perforating gun along. The downward motion of the plug in turn pushes the cement out the bottom end of the casing and into the annulus. The cement in the annulus is allowed to set and the perforating gun is activated.

12 Claims, 3 Drawing Sheets

26a
24a
20a 30
5a
7a
9
32
26
23
20
21
22
24a

WIPER PLUG PERFORATING SYSTEM

CROSS REFERENCE TO RELATED APPLICATIONS

This application claims priority to and the benefit of co-pending U.S. Provisional Application Ser. No. 61/031,966, filed Feb. 27, 2008, the full disclosure of which is hereby incorporated by reference herein.

BACKGROUND

1. Field of Invention

The invention relates generally to the field of oil and gas production. More specifically, the present invention relates to a perforating system. Yet more specifically, the present invention relates to a perforating gun coupled to a plug.

2. Description of Prior Art

Perforating systems are used for the purpose, among others, of making hydraulic communication passages, called perforations, in wellbores drilled through earth formations so that predetermined zones of the earth formations can be hydraulically connected to the wellbore. Perforations are needed because wellbores are typically completed by coaxially inserting a pipe or casing into the wellbore. The casing is retained in the wellbore by pumping cement into the annular space between the wellbore and the casing. The cemented casing is provided in the wellbore for the specific purpose of hydraulically isolating from each other the various earth formations penetrated by the wellbore.

FIG. 1 illustrates one example of a known operation for cementing a casing within a wellbore. As shown, a vertical wellbore 5 lined with casing 7 is formed through a subterranean formation 9. An annulus 8 exists in the space between the wellbore 5 and casing 7; cement 11 is forced into the annulus 8 to bond the casing 7 within the wellbore 5. This typically involves first injecting cement 11 into the casing 7 and landing a wiper plug 13 in the casing 7 above the cement 11. The wiper plug 13 shown includes a textured outer surface that seals against the casing 7 inner diameter preventing cement 11 flow between the wiper plug 13 and the casing 7.

Completion fluid 15 is pumped from an injection system 17 in the wellbore 5 above the wiper plug 13. Pressure from the fluid 15 forces the wiper plug 13 and cement 11 toward the wellbore 5 bottom. Sufficient applied pressure forces the cement 11 past the end of the casing 7 and to the wellbore 5 bottom. There the cement 11 enters the annulus 8 bottom and flows upward in the annulus 8 forced by the continued inflow of the pressurized completion fluid 15. Ultimately, the wiper plug 13 reaches the wellbore 5 bottom and couples with a float collar (not shown), where the plug 13 will likely remain indefinitely, unless the wellbore 5 depth is later increased. The cement 11 flowed into the annulus 8 is allowed to cure and set before further downhole operations are commenced.

SUMMARY OF THE INVENTION

Disclosed herein is a method of wellbore operations. In an embodiment a method includes injecting cement into casing that is circumscribed by a wellbore and an annulus formed between the casing and wellbore, deploying an assembly into the wellbore that includes a perforating gun, shaped charges in the perforating gun, and a plug attached to the perforating gun, forcing the plug with the attached assembly down the wellbore with fluid so that the cement exits the casing bottom and flows into the annulus to bond the casing to the wellbore, and activating the perforating gun. The plug and gun can be attached by a line, a tubular member, wireline, slickline, a chain, tubing, or combinations thereof, optionally; the plug can be on the perforating gun itself. The method can include adding a second perforating gun in the wellbore. Plug embodiments include a cylindrically shaped body having an outwardly radially extending ridge in sealing contact with the casing.

Also provided herein is a method of perforating a subterranean formation that includes deploying a perforating gun system having a perforating gun with shaped charges into a wellbore, forming a pressure differential across a portion of the gun system to force the perforating gun within the wellbore, locating the perforating gun system at a location in the wellbore, and detonating the shaped charges in the wellbore. This embodiment can further comprise attaching a plug to the perforating gun system that can sustain a pressure differential along its length. A flexible member can be used for attaching the plug and gun system.

An example of a perforating system is included herein. In an embodiment the system is moveable along a bore of a casing disposed in a wellbore and includes a perforating gun freely deployable in the casing bore without an attached deployment member, shaped charges in the perforating gun, a plug connected to the perforating gun, a higher pressure side on the side of the plug proximate to the wellbore entrance, and a lower pressure side on the side of the plug proximate to the wellbore bottom, so that a force is generated by a difference in pressure between the higher pressure side and the lower pressure side to move the perforating system in the casing. The plug can include ridges on its lateral sides radially extending outward into sealing contact with the casing. The system may further include a float collar selectively attachable to the plug. The system may further have a first fluid in the casing and a second fluid in the casing, wherein the first and second fluids are separated by the plug.

BRIEF DESCRIPTION OF DRAWINGS

Some of the features and benefits of the present invention having been stated, others will become apparent as the description proceeds when taken in conjunction with the accompanying drawings, in which.

Figure 2:
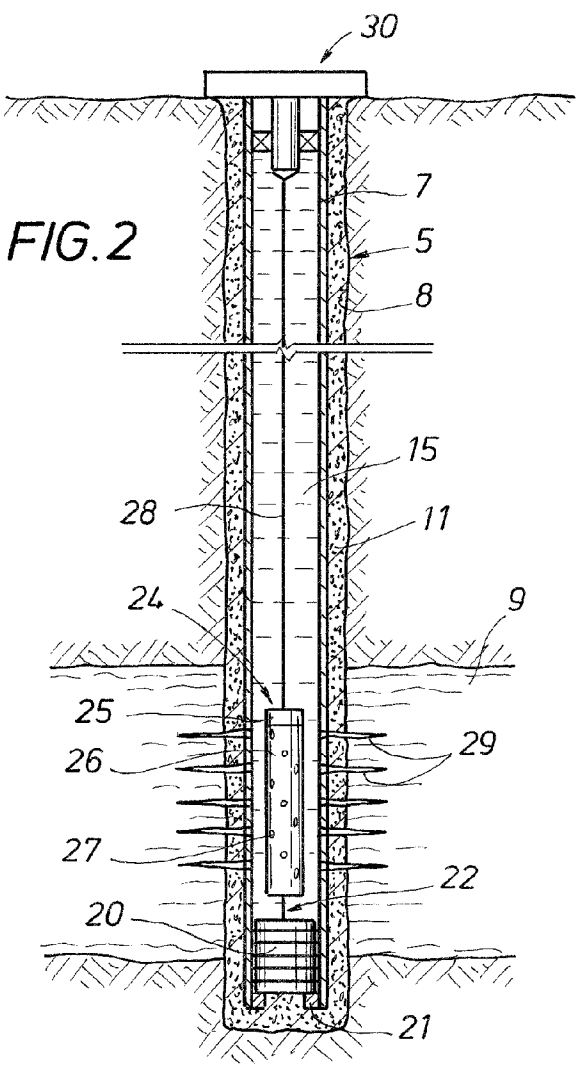
FIG. 2 is a cutaway view illustrating a combined perforating and wiper plug operation in accordance with the present disclosure.
Figure 1:
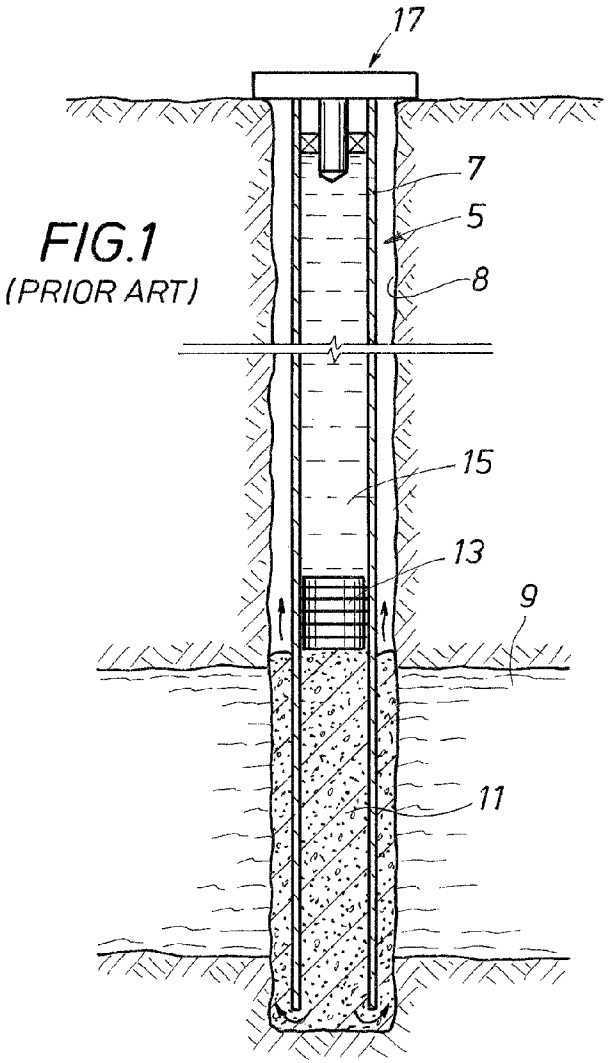
FIG. 1 (PRIOR ART)
FIG. 1 depicts a sectional view of a prior art example of a casing cementing operation.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The present invention will now be described more fully hereinafter with reference to the accompanying drawings in which embodiments of the invention are shown. This invention may, however, be embodied in many different forms and should not be construed as limited to the illustrated embodiments set forth herein; rather, these embodiments are provided so that this disclosure will be thorough and complete, and will fully convey the scope of the invention to those skilled in the art. Like numbers refer to like elements throughout. For the convenience in referring to the accompanying figures, directional terms are used for reference and illustration only. For example, the directional terms such as "upper", "lower", "above", "below", and the like are being used to illustrate a relational location.

It is to be understood that the invention is not limited to the exact details of construction, operation, exact materials, or embodiments shown and described, as modifications and equivalents will be apparent to one skilled in the art. In the drawings and specification, there have been disclosed illustrative embodiments of the invention and, although specific terms are employed, they are used in a generic and descriptive sense only and not for the purpose of limitation. Accordingly, the invention is therefore to be limited only by the scope of the appended claims.

FIG. 2 illustrates in cross-sectional view one embodiment of a system and method for cementing and for perforating. In this embodiment, a wiper plug 20 is shown contacting a float collar 21 provided at the casing 7 end. The system and method described herein is not limited to the embodiments of wiper plug 20 and float collar 21 illustrated herein, but can include any now developed or later known apparatus for cementing a casing 7 within a wellbore 5. A perforating system 24 is shown coupled to the wiper plug 20. The perforating system 24 comprises a perforating gun 26 with shaped charges 27 for creating perforations 29 through the casing 7 and into the surrounding formation 9. In the embodiment shown, a line 22 couples the perforating gun 26 to the wiper plug 20.

An optional wireline 28 may be used to deploy the perforating gun 26 into the wellbore 5 and to convey an initiation signal for detonating the shaped charges 27. The wireline 28 can also be used to remove the perforating gun 26 from the wellbore 5. However, as discussed below, the perforating gun 26 can also be free floating in the wellbore 5 attached to a wiper plug 20 without being suspended from a deployment member, such as a wireline 28. Additionally, the shaped charge 27 detonation signal may be from a timer circuit, telemetry, or other communication means. After shaped charge 27 detonation, the gun 26 can remain in the wellbore 5, or retrieved using fishing techniques. A fishing neck (not shown) may be included on the perforating gun 26 for later retrieval. To ensure the perforating gun 26 can be detached from the wiper plug 20, a frangible link may be included in the connection between the perforating gun 26 and the wiper plug 20. Alternatively, the coupling between the perforating gun 26 and the wiper plug 20 may include a detachment mechanism automatically activated upon shaped charge 27 initiation, after a programmed delay, or manually on a command from the surface.

In one mode of operation of the embodiment illustrated in FIG. 2, a typical cementing operation may take place by applying completion fluid 15 from an injection system 30 to the upper or high pressure side of the wiper plug 20. Alternatively, the substance added into the wellbore 5 above the wiper plug 13 may be something other than completion fluid and optionally it may be pressurized. Examples of such a substance include brine, acidizing fluids, alcohols, mud based fluids, polymeric compounds, other completion fluids, and combinations thereof. As discussed above, the continued application of completion fluid 15 urges the cement 11 into the bottom portion of the wellbore and up the annulus 8 formed between the casing 7 and wellbore 5. After the wiper plug 20 engages the float collar 21 the cement 11 may be given time to cure within the annulus 8. It is believed that it is well within the capabilities of those skilled in the art to determine an appropriate and/or method for establishing the time period to allow a proper set or setting of the cement 11.

The shaped charges 27 may be initiated after the cement 11 has set where the resulting detonation creates the perforations 29. Optionally, shaped charge 27 detonation can occur before the cement 11 has set or been cured. In an alternative, the shaped charges 27 are detonated as the perforating gun 26 is being drawn downward within the borehole 5. Eliminating a downhole tool removal/deployment step is an advantage of combining cementing with perforating. A control module 25 is shown optionally provided with the perforating gun 26. Perforating gun 26 operations can be maintained by the control module 25. In an example, the control module 25 can include a control module for receiving and sending control commands. The module 25 can also include a firing head, an initiator, and an initiator module.

Figure 3:
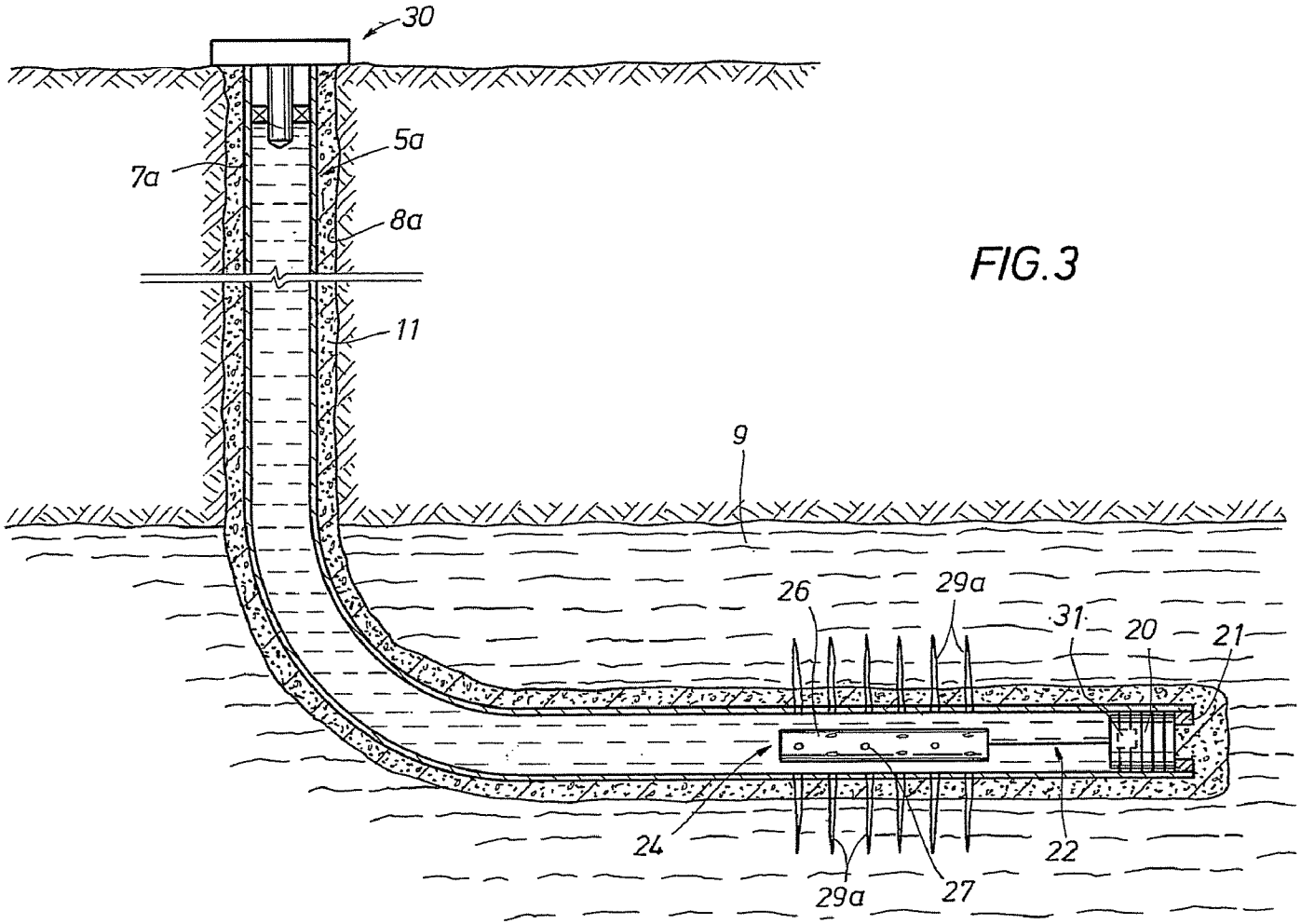
FIGS. 3 and 4 illustrate embodiments of a combination perforating and wiper plug operation in a deviated wellbore.

FIG. 3 is a side view of a deviated wellbore 5*a* with casing 7*a* and an annulus 8*a* filled with cement 11 between the wellbore 5*a* and casing 7*a*. The wellbore 5*a* is shown extending through a formation 9 having a generally horizontal section. As shown, the perforating gun 26 is in the generally horizontal portion having been pulled into position by the wiper plug 20 and line 22. Thus utilizing the present method deviated wellbores can be perforated with perforating guns not on tubing. Additionally, the wellbore 5*a* can be perforated and cemented without removing/redeploying a downhole tool. Additionally, it should be pointed out that the line 22 length can be tailored to accommodate specific perforating situations and is not limited to a specified length. Attaching the perforating gun 26 to the wiper plug 20 is not limited to the use of the line 22, but includes any other mode of attachment, including a rigid or flexible member attaching device. Examples include direct attachment (see FIG. 5), a tubular member, a rod, chain, slickline, and combinations of these. The tubular member includes tubing, tubulars, as well as deployed members referred to in the art as "subs".

Figures 4, 5:
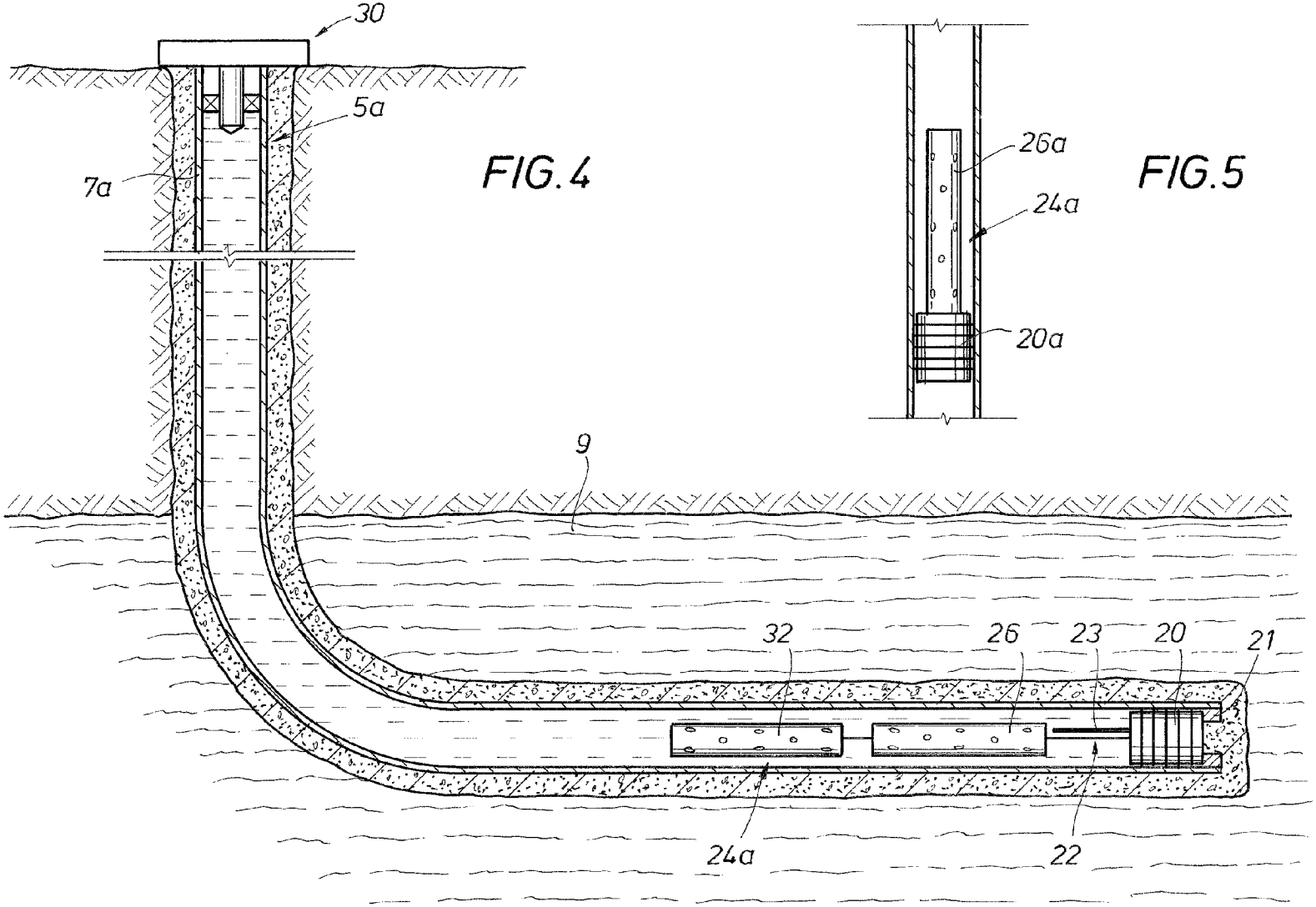
FIG. 5 illustrates a side view of an alternative embodiment of a system for perforating and cementing.

FIG. 4 illustrates another embodiment of a perforating and/or cementing system disclosed herein shown disposed in a wellbore 5*a* lined with casing 7*a*. In this embodiment an additional perforating gun 32 is included with a perforating system 24*a*. It should be pointed out; however, that the number of perforating guns is not limited to those illustrated herein, but can include any number of individual perforating guns and/or a number of perforating strings.

Purposes of the wiper plug include: (1) acting as a barrier between the cement slurry and the completion fluid; (2) to clean the wellbore; (3) preventing backflow of the cement slurry by being locked in place. Optionally, the perforating system may be included with a sensor circuit 31 having a timer that recognizes setting of the wiper plug 20 onto its associated float collar 21. After the wiper plug 20 with the sensor circuit 31 contacts the collar 21 contact timer can then initiate a countdown sequence that when finished would initiate detonation of the shaped charges 27.

FIG. 5 provides in side view an optional embodiment of a system for perforating and cementing. The system 24*a* comprises a perforating gun 26*a* coupled to a wiper plug 20*a*. The perforating gun 26*a* can be directly attached to the wiper plug 20*a* upper surface; alternatively a single body of material can be used to form the perforating gun 26*a* and wiper plug 20*a*. Yet further optionally, wiper plug elements, i.e. radial members extending outward into sealing contact with the wellbore inner surface, may be included on the perforating gun outer surface thereby integrating a perforating gun with a wiper plug.

The scope of the embodiments discussed herein is not limited to systems disposed on wireline, but any type of deployment member, such as slickline, tubing, and any other form of deploying a tool within a wellbore. A timing circuit can be used for perforating gun detonation in either a wireline/slickline deployment or in a freely deployed scenario. The timing circuit may be initiated upon deployment of the system into the wellbore, on landing at the float collar, contact with a timing rod 23 extending from the wiper plug 22 (FIG. 4), or anytime between. Perforating gun detonation may also take place by pressure, memory based, or telemetry. Alternatives to the embodiments discussed may include a wiper plug assembly behind the cement wiper plug. Additionally, the timing circuit can be electrical, mechanical, or ballistic.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

What is claimed is:

1. A method of wellbore operations comprising:

injecting cement into casing that is circumscribed by a wellbore and an annulus formed between the casing and wellbore;

deploying an assembly into the wellbore that includes a perforating gun, shaped charges in the perforating gun, and a plug attached to the perforating gun;

forming a pressure gradient across the plug to force the plug with the attached assembly down the wellbore so that the cement exits the casing bottom and flows into the annulus to bond the casing to the wellbore;

activating the perforating gun;

detaching the plug from the perforating gun; and removing the perforating gun from the wellbore.

2. The method of claim 1, further comprising coupling the plug to a perforating gun by an attachment selected from the list consisting of a line, a tubular member, wireline, slickline, a chain, tubing, and combinations thereof.

3. The method of claim 1, wherein the plug circumscribes a portion of the perforating gun.

4. The method of claim 1, further comprising allowing the cement to set before the step of perforating.

5. The method of claim 1, further comprising adding completion fluid in the casing.

6. The method of claim 1, further comprising adding a second perforating gun in the wellbore.

7. The method of claim 1, wherein the plug comprises a cylindrically shaped body having an outwardly radially extending ridge in sealing contact with the casing.

8. A method of cementing and perforating in a subterranean formation comprising:

providing a perforating gun system having a perforating gun with shaped charges, a plug on an end of the system, and a flexible member connected on an end to an end of the perforating gun and on a distal end to the plug;

injecting cement into casing inserted within a wellbore;

deploying the perforating gun system into a wellbore and oriented so that the plug is inserted into the wellbore before the perforating gun;

applying a pressurized fluid on a surface of the plug facing the perforating gun to push the perforating system within the wellbore and thereby urge the cement through a lower end of the casing and into an annulus between the casing and the wellbore;

locating the perforating gun system at a location in the wellbore;

detonating the shaped charges in the wellbore;

detaching the plug from the perforating gun; and removing the perforating gun from the wellbore.

9. The method of claim 8, further comprising attaching the plug to a float collar in the casing.

10. The method of claim 8, wherein the end of the perforating gun distal from the plug is attached to a wireline suspended from an upper end of the wellbore, and wherein the perforating gun is removed from the wellbore with the wireline.

11. The method of claim 1, further comprising sensing when the wiper plug contacts a float collar in the wellbore, initiating a countdown sequence, and initiating detonation of the shape charges when the countdown sequence is complete.

12. The method of claim 1, wherein the assembly is deployed into a horizontal wellbore.

* * * * *